United States Patent [19]

Iwanami et al.

[11] Patent Number: 4,650,405

[45] Date of Patent: Mar. 17, 1987

[54] SCROLL PUMP WITH AXIALLY SPACED PUMPING CHAMBERS IN SERIES

[75] Inventors: Shigeki Iwanami, Nishio; Mitsuo Inagaki; Hideaki Sasaya, both of Okazaki, all of Japan

[73] Assignee: Nippon Soken, Inc., Nishio, Japan

[21] Appl. No.: 799,252

[22] Filed: Nov. 18, 1985

[30] Foreign Application Priority Data

Dec. 26, 1984 [JP] Japan ..... 59-276896

[51] Int. Cl.[4] ..... F04C 18/04; F04C 23/00

[52] U.S. Cl. ..... 418/5; 418/55; 418/60

[58] Field of Search ..... 418/5, 55, 60

[56] References Cited

U.S. PATENT DOCUMENTS

| | | | |
|---|---|---|---|
| 3,560,119 | 2/1971 | Busch et al. | 418/55 |
| 3,802,809 | 4/1974 | Vulliez | 418/5 |
| 4,466,784 | 8/1984 | Hiraga | 418/55 |

FOREIGN PATENT DOCUMENTS

| | | | |
|---|---|---|---|
| 567297 | 12/1958 | Canada . | |
| 57-171002 | 10/1982 | Japan | 418/55 |
| 57-203801 | 12/1982 | Japan | 418/60 |

*Primary Examiner*—John J. Vrablik

*Attorney, Agent, or Firm*—Cushman, Darby & Cushman

[57] ABSTRACT

A multiple-turn scroll pump comprises a pumping unit on each lateral side of a base plate of an oscillatable scroll piston driven by an eccentric drive. Each pumping unit includes a spirally shaped groove in a scroll housing and a spirally shaped displacement blade forming part of the scroll piston. The groove in one of the pumping units extends from the peripheral part of the scroll housing through at least one turn of a spiral and terminates at the intermediate part of the housing. The groove in the other pumping unit also begins close to the peripheral part of the scroll housing but extends through a number of spiral turns greater than that of the groove in the first pumping unit. Passages are provided in the scroll piston to communicate grooves in both units in such a manner that the fluid drawn into the first pumping unit is compressed mainly in the second pumping unit and is discharged solely therefrom. Mechanism for constraining the movement of the oscillating piston with respect to the scroll housing is conveniently housed within the confinement of the groove in the first pumping unit to reduce the overall radial dimension of the pump.

9 Claims, 11 Drawing Figures

SCROLL PUMP WITH AXIALLY SPACED PUMPING CHAMBERS IN SERIES

BACKGROUND OF THE INVENTION

1. Field of the Invention

The present invention relates to a scroll pump which may be effectively used as a compressor for pressurizing a refrigerant in an automobile air-conditioning system.

2. Description of the Related Art

Canadian Pat. No. 567,297 issued Dec. 9, 1958 to John L. Jones and entitled "Scroll Pump" discloses in FIGS. 1 through 3 a scroll pump having a casing provided with a spirally shaped groove called a female scroll. An impeller carrying a fluid displacement means called a male scroll and cooperating with the female scroll is adapted to be oscillated about a fixed axis to perform a pumping action.

In the scroll pump of this nature, the pump capacity may be augmented by increasing the radial dimension of the male and female scroll members or by increasing the axial dimension thereof. The former approach would result in an increase in the size of the pump or compressor and, hence, would fail to meet recent demands for a more compact, light-weight compressor suitable for installation in an automobile. The latter method is hard to follow from a practical point of view, in consideration of the inevitable low productivity that would result from the difficulties arising when attempting to machine male and female scrolls having a large axial length.

Another approach to increasing the compressor capacity is to provide a pumping unit on each side of the impeller, as disclosed in FIG. 4 of the afore-mentioned Canadian patent, each pumping unit comprising a male and a female scroll. In the present specification and appended claims, this structure will occasionally be referred to as the twin-unit type scroll pump. Although this arrangement enables the pump capacity to be twice augmented without increasing the overall radial dimensions, a problem arises in that the twin-unit scroll pump of Jones is not suitable for use as a compressor for a refrigerant because the male and female scrolls extend only through an arc of about 360° so that the output delivery pressure of the pump cannot be brought to a level high enough to effectively operate a vehicle air-conditioning system.

In Japanese Patent Unexamined (Kokai) Publication No. 57-203801 published Dec. 14, 1982 and entitled "Scroll-Type Fluid Machine", with Y. Hattori et al. named as inventors, there is disclosed an oscillating-piston fluid machine wherein similarly-shaped two scroll-type pumping units are provided on both sides of a base plate of the oscillating piston. In each of the pumping units, the male and female scrolls extend, respectively, through two or more spiral turns. This arrangement may be termed a "multiple-stage" fluid machine in the sense that, when the machine is operated as a pump or compressor, the fluid trapped between the male and female scrolls in the outermost or first spiral turn thereof is first compressed to a certain pressure level during the first oscillation of the piston and is then forwarded, in the terminal phase of one complete oscillation of the piston, to the second or subsequent spiral turn of the male and female scrolls wherein the fluid is further compressed to a higher pressure level during the second oscillation of the piston. Thus, when compared with the single-turn or single-stage scroll pump of Jones, the multiple-stage twin-unit scroll machine of Hattori et al., when used as a compressor, is capable of delivering the fluid under a higher pressure, while taking advantage of the twin-unit arrangement.

As illustrated in the drawings of Japanese Patent Publication No. 57-203801, the male and female scroll members extend spirally inwardly and terminate in the vicinity of the central part of the machine. The piston 1 is oscillated by an eccentric shaft 13 coupled to a shaft 2 integral with the oscillating piston. As the piston is oscillated, the respective pumping units operate independently from each other but the outputs from both pumping units are brought together through ports 3 in the piston and are discharged through an outlet 7. To constrain the oscillating movement of the piston with respect to the scroll housing, a bearing 4 is provided having a pin 10 slidably engaged in a circular groove 9. Since the central part of the machine is designed to form the inner end of the groove or female scroll and is not available for accommodating the constraining mechanism 4/9, Hattori et al. provide the constraining mechanism at the peripheral part of the machine. This arrangement suffers from the disadvantage that the radial dimension of the machine is thus increased.

Another example of the twin-unit multiple-stage scroll pump is described in Japanese Patent Unexamined (Kokai) Publication No. 57-171002, published Oct. 21, 1982 and entitled "Scroll-Type Machine", with T. Yuasa et al. named as inventors. In the oscillating piston machine illustrated therein, the male and female scroll members extend through approximately three spiral turns to terminate at the central part of the machine so that, in this area, there is no space available for an eccentric drive and a piston constraining mechanism. Thus, as shown in FIGS. 2 and 3 of that publication, Yuasa et al. provide three circumferentially spaced eccentric/bearing assemblies 6/22 which are arranged along the perimeter of the oscillating piston and are driven by an input shaft 8 through gears 7, 7'. This arrangement necessarily increases the radial size of machine and renders it impossible to provide a compact, light-weight compressor.

SUMMARY OF THE INVENTION

The primary object of the present invention is to provide a compact, light-weight scroll pump having an extended pump capacity.

Another object of the invention is to provide a scroll pump which is stable and reliable in operation.

This invention is based on the finding that, in a multiple-stage twin-unit scroll pump, the pump capacity is determined by the maximum volume of working chambers defined by the outermost spiral turn of the male and female scroll members and that the final stage of compression and delivery may be performed by only one of two pumping units.

The twin-unit multiple-stage scroll pump according to the present invention is designed and constructed in such a manner that the intake fluid is drawn into both pumping units during the initial stage of pumping action but is compressed primarily in one of two pumping units during subsequent stages for delivery from the one pumping unit.

According to the invention, the scroll pump comprises a scroll housing and an oscillating scroll piston, the housing and piston forming together two pumping units. Each unit is arranged on each lateral side of a base plate of the oscillating piston. One of the pumping units, e.g., the first or front pumping unit, comprises a spirally shaped groove in the housing and a correspondingly shaped displacement blade integral with the base plate, the groove beginning close to the peripheral part of the housing and extending through at least one turn of a spiral to terminate at an intermediate part of the housing. The other pumping unit, e.g., the second or rear pumping unit, comprises a spirally shaped groove and a correspondingly shaped displacement blade, the groove of the second unit extending through a number of turns greater than that of the groove in the first unit and terminating in the vicinity of the central part of the scroll housing. One or more passages are provided in the scroll piston to communicate the innermost region of the groove in the first pumping unit with the corresponding region of the groove in the second unit. Also provided are a fluid inlet, a fluid outlet, and an eccentric drive to oscillate the piston. A mechanism for constraining the movement of the oscillating piston is arranged partly in the part of the scroll housing located radially inwardly of the groove in the first pumping unit.

With this arrangement, when the scroll piston is oscillated, the intake fluid is drawn into both pumping units and is trapped in the sealed variable-volume working chambers defined by the outermost first spiral turn of the groove and displacement blade in respective units. Thus, both pumping units function to perform the intake phase of the pumping action. As the piston is further oscillated through a number of oscillations corresponding to the number of spiral turns in the first pumping unit, the fluid in the working chambers of the first pumping unit is continuously forced, together with the fluid in the working chambers of the second unit, into the working chambers of the second unit defined by and moving into the subsequent spiral turn of the groove and displacement blade of the second unit. Subsequent phases of the pumping action, i.e., the further compression phase and delivery phase, are carried out solely by the second pumping unit. Therefore, the scroll pump according to the invention provides a pump capacity equal to that of the conventional twin-unit scroll pump described hereinbefore, while providing a reduced number of spiral turns in the first pumping unit. The part of the scroll housing located radially inwardly of the spiral groove of the first unit may be conveniently utilized for accommodating the piston constraining mechanism and a part of the eccentric drive, thereby reducing the overall radial size of the pump and improving the stability of operation.

These and other features of the present invention will become apparent from the following detailed description made with reference to the accompanying drawings.

DESCRIPTION OF THE PREFERRED EMBODIMENTS

Figure 1:
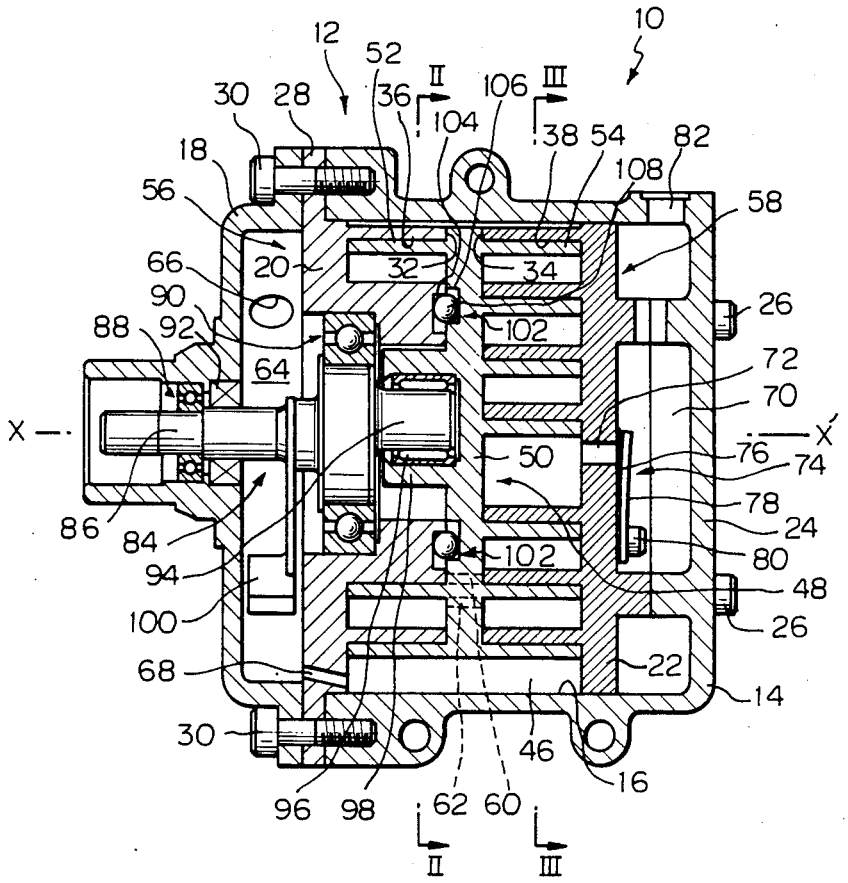
FIG. 1 is a vertical cross-sectional view of the scroll pump according to the invention.

Referring to FIG. 1, the scroll pump, generally designated 10, includes a scroll housing 12 having a central axis XX'. In the illustrated embodiment, the scroll housing 12 comprises an outer shell 14 with a substantially cylindrical bore 16, a front cover 18, a stationary front female scroll member 20, and a stationary rear female scroll member 22. The rear female scroll member 22 is closely fitted within the bore 16 of the outer shell 14 and is secured to a rear wall 24 of the shell 14 by screws 26. The front female scroll member 20 is also closely fitted within the shell bore 16 and is provided with a radially outwardly extending flange 28. The front cover 18, front female scroll member 20 and outer shell 14 are fastened together by a plurality of bolts 30, with the flange 28 of the front female scroll sandwiched between the cover 18 and shell 14.

The front female scroll member 20 has a planar surface 32 axially spaced from and facing a planar surface 34 of the rear female scroll member 22, the surfaces 32 and 34 being perpendicular to the axis XX'. The front and rear female scroll members 20 and 22 are provided with spirally shaped first and second grooves 36 and 38 extending axially in opposite directions from the respective planar surfaces 32 and 34.

Figure 2:
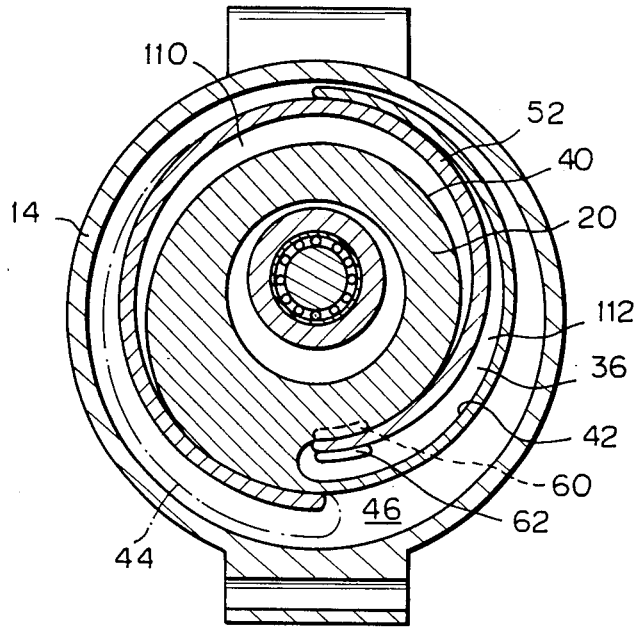
FIGS. 2 and 3 are cross-sectional views taken along the line II—II and line III—III of FIG. 1, respectively, and illustrating the scroll piston in its topmost position.

As shown in FIG. 2, the groove 36 in the front female scroll member 20 extends spirally inwardly and terminates in the part of the front female scroll member 20 intermediate of the outer shell 14 and the axis. The inner side wall 40 of the groove 36 extends through approximately one spiral turn. In the illustrated embodiment, the outer side wall 42 of the groove 36 extends through only approximately half of a spiral turn and the remaining half spiral turn, indicated by the dotted line 44 in FIG. 2, of the outer side wall 42 is cut out to ensure that the outer region of the groove 36 is merged into an annular plenum chamber 46 defined between the outer shell 14, on the one hand, and the front and rear female scroll members 20 and 22, on the other hand. Although in the illustrated embodiment a displacement blade of an oscillating scroll piston (described later) is not brought into sealing engagement with the outer side wall 42 of the groove through one entire spiral turn because the outer side wall is partly cut out, the groove 36 may be considered as extending approximately through about one spiral turn because the displacement blade is moved while keeping a sealing engagement with the inner side wall 40 through about one complete spiral turn. The term "extending through one spiral turn" or "extending through a number of spiral turns" as used hereinafter and in the appended claims with reference to the spiral grooves 36 and 38 is intended to include not only the configuration in which a groove extends through one or more spiral turns with its side walls entirely enclosed, as shown by the dotted line 44 in FIG. 2, but also the configuration in which part of the side wall is omitted or cut out and the groove is open-ended to provide communication with the plenum chamber 46.

Figure 3:
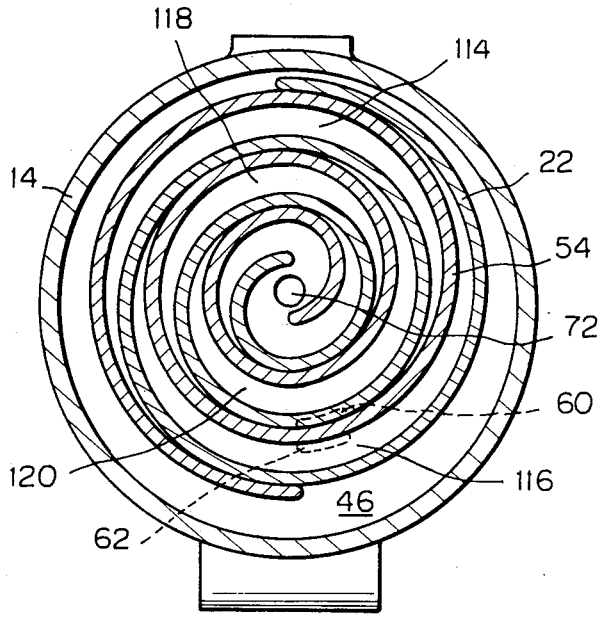

As illustrated in FIG. 3, the second groove 38 in the rear female scroll member 22 extends through approximately three spiral turns and terminates in the vicinity of the central part of the scroll member 22. Similar to the first groove 36, the outer region of the second groove 38 is open-ended and is communicated with the surrounding plenum chamber 46.

An oscillatable scroll piston 48 comprises a disk-shaped base plate 50 slidably and fluid-tightly accommodated between the axially spaced planar surfaces 32 and 34. The scroll piston 48 also includes first and second fluid displacement blades 52 and 54 integral with the base plate 50 and extending axially in opposite directions into the grooves 36 and 38. It will be noted from FIGS. 2 and 3 that the first fluid displacement blade 52 extends in the spiral direction through approximately one spiral turn corresponding to the first groove 36, and the second fluid displacement blade 54 extends through approximately three spiral turns corresponding to the second groove 38. As is well known in the art, the grooves 36 and 38 and the fluid displacement blades 52 and 54 are so shaped and sized that, upon oscillation of the piston about the axis XX' with a predetermined eccentricity, the displacement blades are held in sealing engagement with the side walls of the grooves, thereby defining progressively-moving variable-volume working chambers. The front female scroll member 20, first displacement blade 52, and the base plate 50 together form the first or front pumping unit 56. The rear female scroll member 22, second displacement blade 54, and the base plate 50 together form the second or rear pumping unit 58.

The base plate 50 of the oscillatable piston 48 has arcuate inner and outer passages 60 and 62 therethrough for communicating the innermost region of the first groove 36 with a corresponding region of the second groove 38. The passages 60 and 62 extend along the transverse cross-section of the displacement blades 52 and 54 and are positioned adjacent to the inner and outer lateral sides of the innermost end of the first displacement blade 52. The flow area of the passages 60 and 62 may be determined depending on the capacity of the first pumping unit 56. In order to prevent the high pressure fluid in the working chambers under a higher pressure phase from being released toward the working chambers under a lower pressure phase, the passages 60 and 62 have a radial dimension smaller than the radial thickness of the wall of the female scroll members located between two consecutive spiral turns of the grooves.

A fluid intake chamber 64 is defined between the front cover 18 and front female scroll member 20 and this intake chamber 64 may be connected through an inlet port 66 in the cover 18 and through a suitable hose (not shown) to an evaporator of a refrigerating circuit for receiving a refrigerant therefrom. The intake chamber 64 is also connected to the plenum chamber 46 through a passage 68 in the front female scroll member 20.

A delivery chamber 70 is formed between the rear female scroll member 22 and the rear wall 24 of the outer shell 14. The delivery chamber 70 is connected through a central opening 72 in the rear scroll member 22 with the innermost end region of the second groove 38. The opening 72 is closed by a reed valve assembly 74 including a reed valve 76 and a retainer 78 secured by a bolt 80 to the rear female scroll member 22. The outer shell 14 has an outlet port 82 communicating with the delivery chamber 70. The outlet port 82 may be connected by a suitable flexible hose to a condensor of the refrigerating circuit.

The oscillatable scroll piston 48 is oscillated by an externally driven eccentric drive 84 having a shaft 86 coaxial with the housing 12. The shaft 86 is rotatably supported by the front cover 18 and the front female scroll member 20 by means of bearings 88 and 90 and is sealed by a shaft seal mechanism 92. The shaft 86 is provided with an eccentric pin 94 which is offset from the central axis XX' by a distance of eccentricity $\rho$, and which is coupled through an antifriction bearing 96 to a central boss 98 projecting from and integral with the base plate 50 of the piston. The shaft 86 is provided with a balance weight 100.

It should be appreciated that since the groove 36 in the front female scroll member 20 terminates in the intermediate region thereof, the central part of the scroll member 20 is effectively utilized to form a stepped bore for receiving the bearing 90 and for accommodating the oscillating boss 98 rotatably coupled to the eccentric pin 94. Therefore, the center of gravity of the oscillatable piston 48 may be positioned axially close to the bearing 96. This ensures stable oscillation of the scroll piston 48, thereby enabling stable and reliable operation of the scroll pump.

The oscillating movement of the scroll piston 48 with respect to the scroll housing 12 is controlled by a constraining mechanism which may include at least three bearing assemblies. In the illustrated embodiment, the constraining mechanism comprises four bearing assemblies 102 which are angularly equally spaced apart along a circle coaxial with the axis XX' and which are arranged within the confinement of the first groove 36. Each bearing assembly includes a cylindrical recess 104 formed on the first surface 32 of the front female scroll member 20, a cylindrical recess 106 formed on the frontal side of the piston base plate 50 and positioned with a staggered relationship with respect to the first recess 104, and a rigid ball 108 such as a steel ball. The recesses 104 and 106 have a common diameter equal to the distance of eccentricity of the eccentric pin 94 plus the diameter of the steel ball 108, while the axial depth of the recesses is equal to the radius of the ball 108. As the eccentric drive 84 is rotated from an external power source to oscillate the scroll piston 48 about the axis XX', the ball 108 in each bearing assembly rolls on and along the side walls of the recesses 104 and 106, thereby constraining the movement of the piston with respect to the scroll housing in such a manner that every point on the scroll piston moves along a circle having the radius equal to the distance of eccentricity $\rho$. It should be noted that the ball 108 also rolls on the bottom walls of the recesses 104 and 106 so that the bearing assemblies 102 also serve as axial thrust bearings to support any axial thrust exerted on the scroll piston due to a pressure difference between the first and second pumping units 56 and 58.

The operation of the scroll pump will be described below with reference to FIGS. 2 to 9. FIGS. 2, 4, 6, and 8 show four different phases of the first or front pumping unit 56, and FIGS. 3, 5, 7, and 9 illustrate phases of the rear or second pumping unit 58 corresponding, respectively, to FIGS. 2, 4, 6, and 8. FIGS. 2 and 3 illustrate the relationship between the displacement blades with respect to the female scroll members when the eccentric pin 94 and the scroll piston are in the topmost angular position ($\theta=0$, where $\theta$ is the angle of the shaft 86), FIGS. 4 and 5 when $\theta=90°$, FIGS. 6 and 7 when $\theta=180°$, and FIGS. 8 and 9 when $\theta=270°$.

A fluid such as a refrigerant is drawn into the plenum chamber 46 through the inlet port 66, intake chamber 64, and passage 68.

In the initial operational phase shown in FIGS. 2 and 3, wherein $\theta=0$, the intake fluid in the first pumping unit 56 is trapped within two separate sealed variable-volume working chambers, e.g., the first and second working chambers 110 and 112, which are defined by the displacement blade 52 held in sealing engagement with the side walls of the groove 36, the first working chamber 110 being defined between the inner side wall of the displacement blade 52 and the outer side wall of the groove 36, and the second working chamber 112 being defined between the outer side wall of the blade and the inner side wall of the groove 36. Similarly, the fluid in the second or rear pumping unit 58 is trapped within the first and second variable-volume working chambers 114 and 116 defined between the second groove 38 and second displacement blade 54. These four working chambers 110, 112, 114, and 116 move in the clockwise direction as the oscillating piston is oscillated clockwise and, on so doing, their volume is continuously reduced. It will be noted that in the position shown in FIGS. 2 and 3, the first and second working chambers 110 and 112 in the first pumping unit 56 are separated from each other by the innermost end of the first displacement blade 52 in sealing engagement with the side wall of the first groove 36. The second working chamber 112 in the front pumping unit 56 is in communication with the second working chamber 116 in the rear pumping unit 58 by way of the outer passage 62 in the scroll piston base plate 50 opening into these chambers, whereas the first working chamber 110 in the front pumping unit 56 is separated from the first working chamber 114 in the rear pumping unit 58 because at this moment the inner passage 60 is closed by the surfaces 32 and 34 of the female scroll members 20 and 22.

Figure 4:
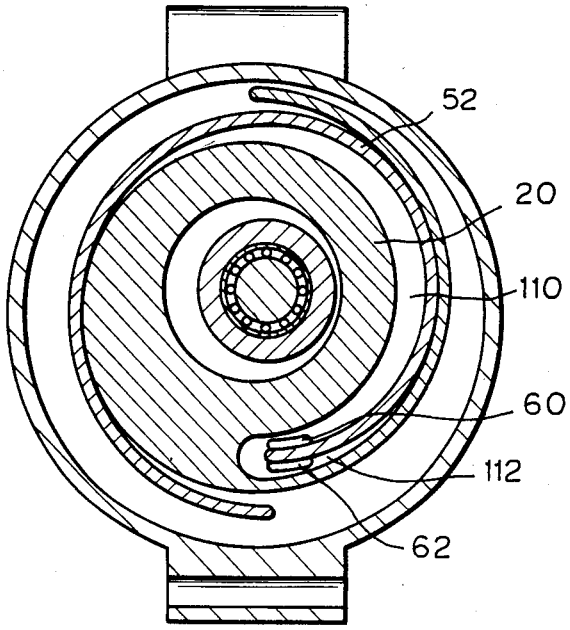
FIGS. 4 and 5 are views similar to FIGS. 2 and 3 and showing the scroll piston oscillated through an angle of 90° from the position shown in FIGS. 2 and 3.
Figure 5:
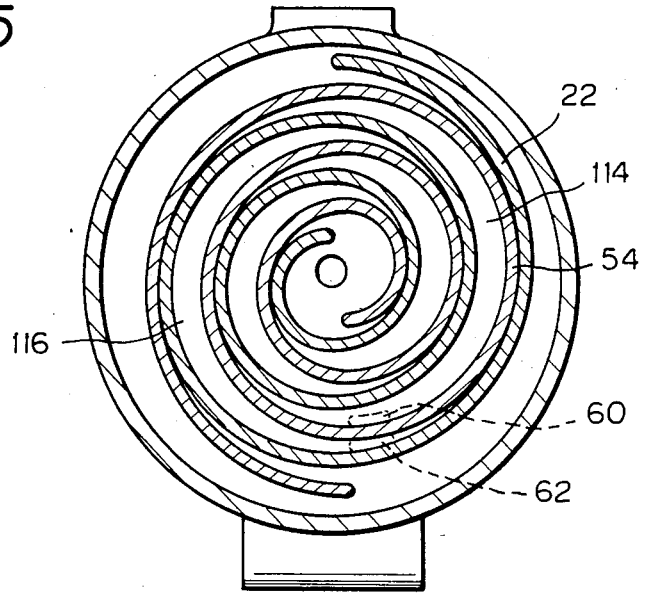

As shown in FIGS. 4 and 5, when the oscillating piston is rotated clockwise through an angle of less than 180°, the first and second working chambers 110 and 112 in the first pumping unit 56 are merged together because the innermost sealing edge of the first displacement blade 52 moves out of engagement with the side wall of the first groove 36. It will be noted that during this operational phase, the first and second grooves 36 and 38 are communicated with each other by the inner and outer passages 60 and 62 as shown in FIGS. 4 and 5 so that the four working chambers 110, 112, 114, and 116 are connected together to form a combined single variable volume working chamber, the volume of which is progressively reduced as the oscillating piston is rotated.

Figure 6:
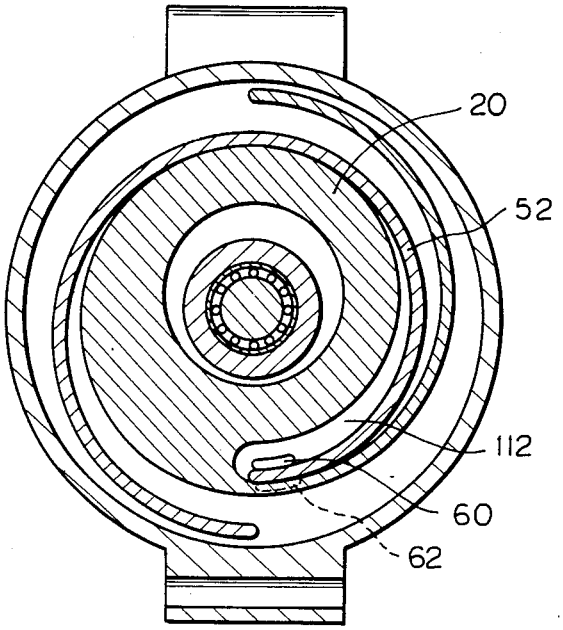
FIGS. 6 and 7 are views similar to FIGS. 2 and 3 and showing the scroll piston oscillated through an angle of 180° from the position shown in FIGS. 2 and 3.
Figure 7:
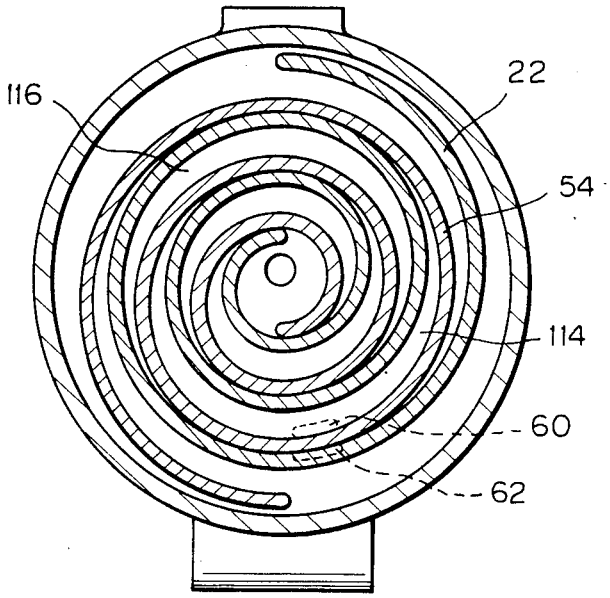

In the position illustrated in FIGS. 6 and 7 where $\theta=180°$, the outer passage 62 is closed by the surfaces 32 and 34 and the second working chamber 116 in the rear pumping unit 58 is isolated, while the first working chamber 110 in the front pumping unit 56 is in communication with the first working chamber 114 in the rear pumping unit 58. The innermost sealing edge of the first displacement blade 52 is again brought into sealing engagement with the semicircular side wall of the first groove 36.

Figure 8:
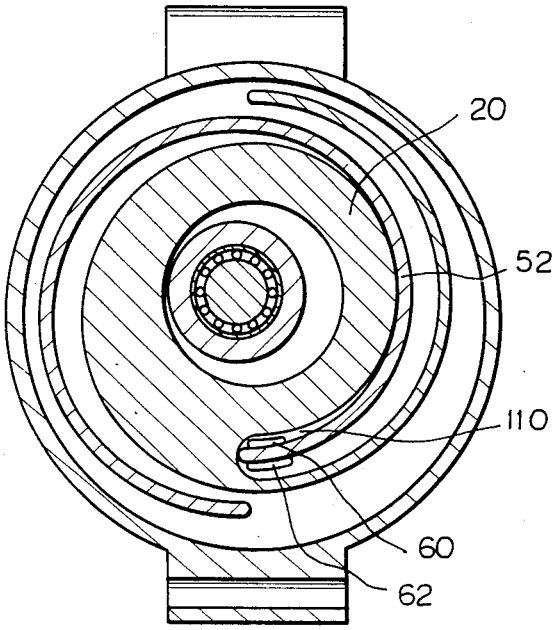
FIGS. 8 and 9 are views similar to FIGS. 2 and 3 and showing the scroll piston oscillated through an angle of 270° from the position shown in FIGS. 2 and 3.
Figure 9:
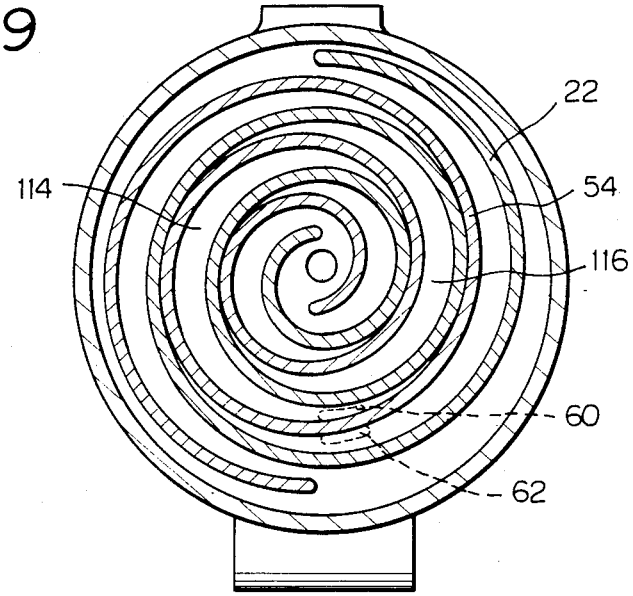

Thereafter, for rotational angle of $\theta$ larger than 180° and less than 360°, the first working chamber 110 in the front pumping unit 56 is scavenged and the fluid therein is forced into the first working chamber 114 in the rear pumping unit 58 through the inner passage 60 opening into these chambers 110 and 114, as shown in FIGS. 8 and 9.

After the scroll piston 48 is rotated through one complete cycle of oscillation, the front and rear pumping units 56 and 58 again commence their intake stage as described above. However, the rear pumping units working chambers referred-to as the first and second working chambers 114 and 116 in the foregoing description made with reference to the first cycle of oscillation have now moved into the inwardly located working chambers 118 and 120 (FIG. 3) defined by the inner or second spiral turn of the groove 38 and displacement blade 54. The volumes of these chambers 118 and 120 are continuously reduced in response to further oscillation of the scroll piston, and the fluid trapped therein is gradually further compressed to a higher pressure level and is finally discharged through the opening 72, delivery chamber 70, and outlet port 82.

In this manner, the second or rear pumping unit 58 serves to perform a complete pumping action including intake, compression, and delivery phases, while the first or front pumping unit 56 only serves to perform the intake phase and a part of the compression phase. The fluid in the first pumping unit 56 is then pumped into the second pumping unit 58 so that the main part of the compression phase and the delivery phase for the fluid drawn into the first pumping unit 56 are performed in the second or rear pumping unit.

Figure 10:
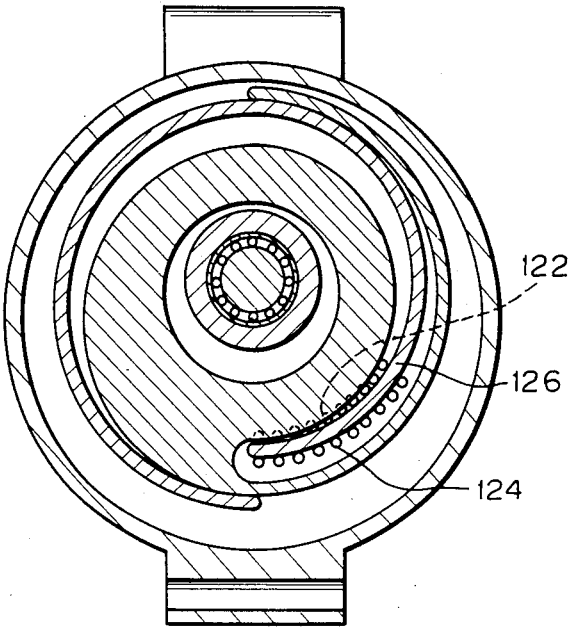
FIGS. 10 and 11 are views similar to FIGS. 2 and 3 but showing a modified embodiment of the present invention.
Figure 11:
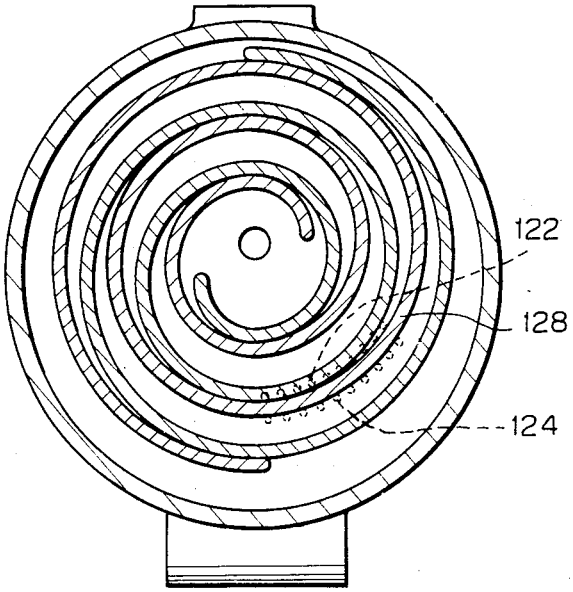

FIGS. 10 and 11 illustrate a modified form of the scroll pump according to the invention. In this embodiment, two series of openings 122 and 124 are provided through the base plate of the scroll piston and are arcuately arranged along and adjacent to the inner and outer sides of the first and second displacement blades 126 and 128. Each of the openings 122 and 124 has a diameter smaller than the radial thickness of the wall of the female scroll members located between two consecutive spiral turns of the grooves, to avoid blow-by of fluid therebetween. The operation of this embodiment is substantially the same as that of the preceding embodiment and need not be described.

Although the present invention has been described herein with reference to the specific embodiments thereof, it should be understood that the invention is not limited thereby and various changes and modifications may be made therein within the scope of the present invention.

In particular, the number of spiral turns of the groove and displacement blade in the first or front pumping unit is not limited to one but may be made two or more. Similarly, the number of spiral turns of the groove and displacement blade in the second or rear pumping unit may be varied in response to the number of spiral turns in the first pumping unit. In any event, the number of spiral turns in the second pumping unit must be greater than that of the first unit and the innermost region of the groove in the first unit must be communicated to the groove in the second unit in such a manner that the fluid in the first unit is finally compressed in and discharged solely from the second pumping unit.

We claim:

1. A scroll pump of the twin-unit type wherein two pumping units are provided including a respective one on each side of a transversally arranged base plate of an oscillatable scroll piston which is adapted to be eccentrically oscillated within a scroll housing, means are provided for eccentrically oscillating said scroll piston in said housing relative to a longitudinal axis and wherein each said pumping unit includes a respective sprially shaped groove in the scrool housing and a spirally shaped fluid displacement blade cooperating with said groove to perform pumping work, fluid inlet means in said housing communicating with said two pumping units, characterized in that the two spiral grooves are of the same hand, that the number of spiral turns of the respective said groove and of the respective said displacement blade of one of the pumping units are both greater than those of said groove and displacement blade in the other said pumping unit, that passage means is provided in said piston for communicating said grooves with each other in such a manner that a fluid compressed in said other pumping unit is forced to flow into said one pumping unit for furhter compression therein, fluid outlet means in said housing communicating with said one pump unit, and that a mechanism for constraining oscillating movement of said piston with respect to said scroll housing is arranged radially inwardly of the respective said groove in said other pumping unit.

2. A scroll pump comprising:

(a) a scroll housing having a central axis and wall means including a radially outer peripheral wall means, said housing defining therein axially-spaced mutually-facing substantially-circular first and second planar surfaces perpendicular to said axis and wall means including respective radially inner walls defining same-hand, spirally-shaped first and second grooves respectively extending from said first and second surface axially in opposite directions with respective uniform transverse cross-sections throughout the axial lengths thereof, said first groove beginning close to said radially outer peripheral wall means of the housing and extending spirally inwardly through at least one spiral turn to terminate at a radially intermediate region of the housing remote from said central axis, said second groove also beginning close to said radially outer peripheral wall means of the housing but extending spirally inwardly through a number of spiral turns which is greater than said at least one spiral turn of said first groove, so as to terminate in the vicinity of a radially central region of the housing, said first groove having a transverse cross-section which is substantially equal in area to that of the second groove except at the radially innermost extent of said first groove at which place said first groove terminates in a closed end whereas a preceding spiral turn of said second groove continuously merges into a subsequent sprial turn of said second groove;

(b) a scroll piston having a disk-shaped base plate and same-hand spirally-shaped first and second fluid displacement blades provided respectively on opposite sides of said base plate, said base plate being accommodated slidably and fluid-tightly between said first and second surfaces of the housing, said first and second displacement blades extending, respectively, axially into said first and second grooves and being so shaped and configured that upon eccentric oscillation of the scroll piston about said axis, said displacement blades cooperate with said inner walls of the grooves to perform a pumping action;

(c) passage means in said base plate of the scroll piston for communicating said first groove at the radially innermost extent thereof with an axially corresponding site in the second groove;

(d) inlet means in said housing for admitting an intake flow of fluid to radially outer sites in said first and second grooves;

(e) outlet means in said housing for discharging the pressurized fluid from a radially innermost site in said second groove to the exterior of the housing;

(f) eccentric drive means for oscillating said scroll piston about said axis of the housing; and (g) means for constraining the movement of said scroll piston with respect to said scroll housing in such a manner that every point on said piston oscillates in a circle, said means for constraining the movement of said piston being disposed at least partly in the scroll housing at a site located radially inwardly of said first groove.

3. A scroll pump according to claim 2, wherein the number of spiral turns of said first groove is one and the number of spiral turns of said second groove is three.

4. A scroll pump according to claim 2, wherein said passage means includes an inner arcuate passage and an outer arcuate passage, both said passages extending along the transverse cross-section of said displacement blades and respectively positioned radially inwardly of and radially outwardly of and adjacent to radially inner and outer sides of said first displacement balde at a radially inner end thereof, said arcuate passages having a radial dimension smaller than the radial thickness of said wall means of said housing located between two consecutive spiral turns of said second groove.

5. A scroll pump according to claim 2, wherein said passage means includes two series of openings positioned along the transverse cross-section of said displacement blades adjacent to and at both sides of the radially innermost extent of said first displacement blade, said openings each having a diameter smaller than the radial thickness of said wall means of the housing located between two consecutive spiral turns of said second groove.

6. A scroll pump according to claim 2, wherein said means for constraining movement of said scroll piston with respect to said scroll housing is adapted to counteract axial thrust exerted on the scroll piston.

7. A scroll pump according to claim 5, wherein said means for constraining movement of the scroll piston with respect to the scroll housing comprises at least three circumferentially spaced bearing assemblies arranged at a juncture of said first surface and one of said sides of the base plate, each said bearing assembly including a cylindrical recess formed on said first surface, a cylindrical recess formed on said one side of the base plate, and a rigid ball simultaneously received in both said recesses, said cylindrical recesses each having a diameter equal to the magnitude of eccentricity of said eccentric drive plus the diameter of said ball, said recesses each having a depth equal to the radius of said ball.

8. A scroll pump according to claim 2, wherein said eccentric drive is coupled with said scroll piston close to said base plate.

9. A scroll pump according to claim 8, wherein said scroll piston includes a boss arranged on the same side of the base plate as said first displacement blade and wherein said eccentric drive includes an eccentric pin engaging said boss.

* * * * *